United States Patent [19]

Felis

[11] Patent Number: 4,750,609

[45] Date of Patent: Jun. 14, 1988

[54] COMBINATION MAILING CARTON AND PORTFOLIO

[76] Inventor: Gia Felis, 1170 Fairfield Beach Rd., Fairfield, Conn. 06430

[21] Appl. No.: 936,452

[22] Filed: Dec. 1, 1986

[51] Int. Cl.[4] ..... B65D 65/12; B65D 65/14

[52] U.S. Cl. ..... 206/1.7; 229/52 A; 229/68 C; 229/87 R

[58] Field of Search ..... 206/1.7, 424, 450, 453; 190/115, 116; 229/40, 52 A, 68 C, 68 R, 87 R, 80, 92.8; 248/205.2

[56] References Cited

U.S. PATENT DOCUMENTS

| | | | |
|---|---|---|---|
| Re. 30,163 | 12/1979 | Meyer et al. | 206/424 |
| 2,011,703 | 8/1935 | Barker | 229/87 R |
| 2,928,582 | 3/1960 | Klein | 229/48 R |
| 3,003,622 | 10/1961 | Hardigg | 206/591 |
| 3,198,420 | 8/1965 | Hiersteiner | 229/68 R |
| 3,303,603 | 2/1967 | Abeson | 206/424 |
| 3,370,818 | 2/1968 | Perr | 248/205.2 |
| 3,381,889 | 5/1968 | Laskow | 229/87 R |
| 3,445,054 | 5/1969 | Champlin | 206/424 |
| 3,664,572 | 5/1972 | Puchkoff et al. | 229/40 |
| 4,114,757 | 9/1978 | Sieffert | 229/40 |
| 4,333,602 | 6/1982 | Geschwender | 229/45 R |

*Primary Examiner*—Jimmy G. Foster

*Attorney, Agent, or Firm*—Arthur T. Fattibene

[57] ABSTRACT

A knockdown mailing carton or portfolio for shipping and/or carrying relatively large sized graphics or artwork formed of a unitary readily foldable blank of sheet material. The blank is specifically formed so that it can be readily folded and secured between the knockdown and erected position. The blank is provided with prescored or formed foldlines to define an opposed front and back panel, with one of the panels formed with integrally connected opposed side or marginal flaps and an end closure flap which are sequentially folded to form a combination mailing carton or portfolio in the erected position thereof. An improvement resides in providing protected adhesive strips which can be readily exposed so that in the erected position the abutting surfaces of the respective panels and flaps are positively secured to maintain the integrity of the assembled carton or portfolio. In another embodiment, a releaseable closure arrangement is provided so as to provide an option of having a releseable closure flap.

1 Claim, 3 Drawing Sheets

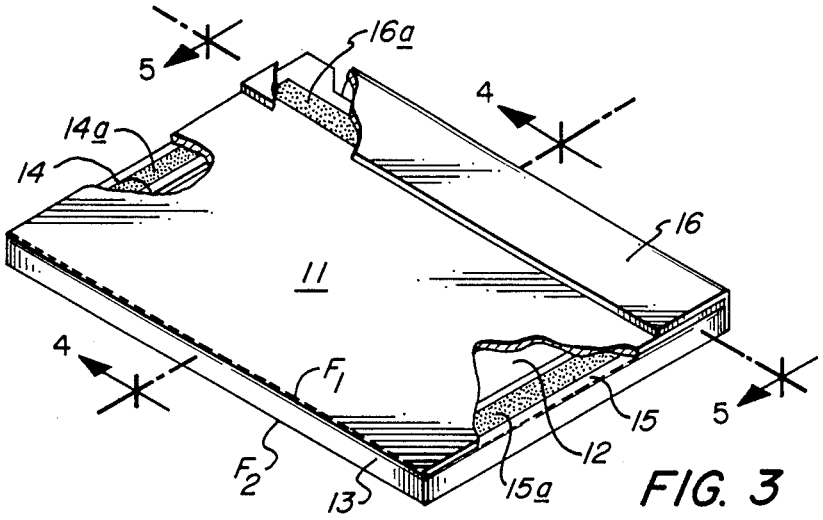
FIG. 3
FIG. 4
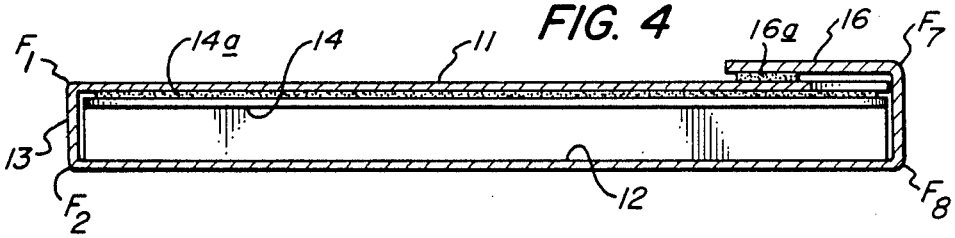
FIG. 5
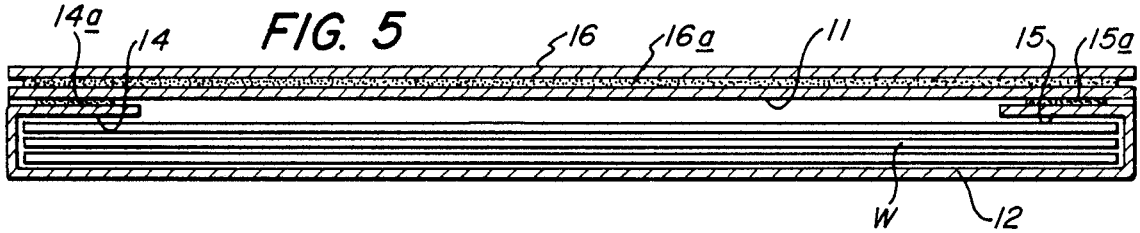
FIG. 6
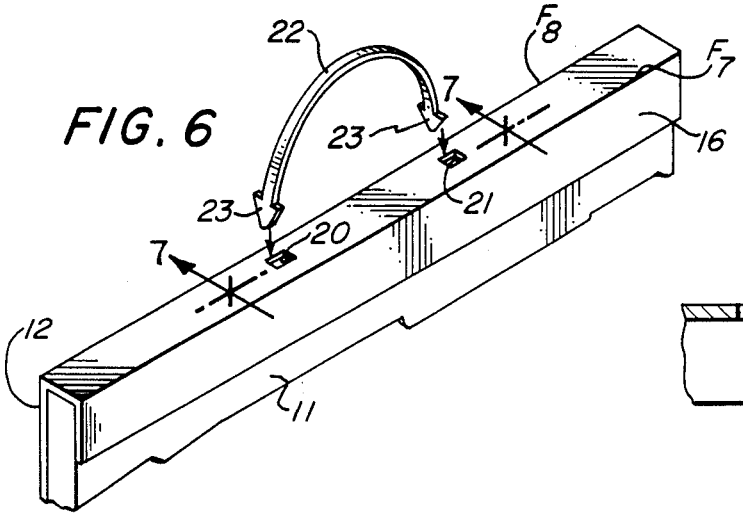
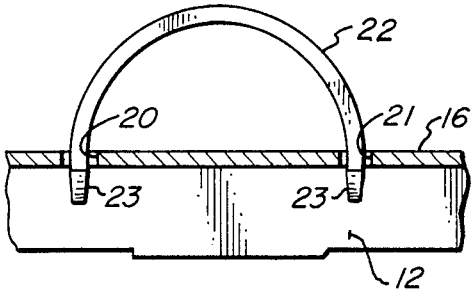
FIG. 7

COMBINATION MAILING CARTON AND PORTFOLIO

FIELD OF INVENTION

This invention is directed to a readily foldable mailing carton and portfolio formed of a pre-scored blank of sheet material which can be readily erected by the user to define a mailing carton and portfolio for accommodating relatively large sized graphics, mechanicals or works of art and the like in their flat, unfolded state.

PROBLEM AND PRIOR ART

Various efforts have been made to provide a shipping or carrying carton for various products. A number of such cartons are known for facilitating the mailing or shipment of books and the like. Such known efforts are disclosed in U.S. Pat. Nos. 3,315,869; 3,325,964; 3,985,230 and 4,114,757. Other types of cartons and/or envelope type devices are also known as evidenced in U.S. Pat. Nos. 2,181,482; 2,256,638; 2,432,052; 2,527,685; 3,580,476; 4,579,277 and United Kingdom Specification No. 610,744.

Despite these various known types of cartons and/or mailing devices, artists and graphic designers involved in various artistic endeavors are confronted with the constant problem of shipping their art work in a safe and convenient manner. The problem is particularly aggrevated when relatively large sized works are required to be shipped, mailed or carried from one place to another in their flat state. Generally, such art work, graphics, mechanicals and the like may range in size from 20"×30", 30"×40" or larger in size, and which sizes are frequently difficult to handle, particularly when such art work or graphics cannot be suitably rolled, and must be handled in its original flat state. More often than not, such finished work is relatively expensive and may be valued at several thousands of dollars in many instances. Heretofore, there has not been available a readily inexpensive and safe means for shipping, mailing and/or carrying such relatively large and flat graphics or works of art. The known portfolio for such works comprises relatively expensive types of oversized brief-type cases, generally formed of leather, in which the artist could carry his work. However, such type brief cases are not suitable for mailing and/or shipping of the art work because of their obvious cost. For this reason, when such graphic or art work was required to be mailed or shipped, the artist would generally make up a package from available materials, in an effort to protect the art work in shipping. Such effort was time consuming and makeshift at best. These home-made mailers frequently proved inadequate and often resulted in considerable damage to the art work shipped therein.

OBJECTS

An object of this invention is to provide a strong, durable, protective mailing carton or portfolio for shipping or carrying relatively large sized graphics or art works in their flat state, which is formed of a unitary blank of foldable sheet material that can be readily formed or folded by the user.

Another object is to provide a knockdown mailing carton or portfolio from a unitary blank of sheet material that can be readily formed about the graphic or art work.

Another object is to provide an improved mailing carton or portfolio that is relatively simple in construction, easy to assemble, relatively inexpensive to fabricate and positive in operation.

Another object is to provide an improved mailing carton specifically adapted to safely handle relatively large, expensive graphics or art works in a simple and efficient manner.

Another object is to provide an improved, relatively inexpensive portfolio for carrying and/or storing relatively large sized graphics or works of art in their flat state.

SUMMARY OF THE INVENTION

The foregoing objects and other features and advantages are attained by a mailing carton or portfolio which is formed from a single blank of foldable sheet material, e.g., cardboard, corrugated board, fiber board or the like. The unitary blank is pre-scored to define a front and back panel which are hingedly connected so as to reversely fold into overlying relationship. Connected to one of the front or back panels are longitudinally disposed, opposed side or marginal flap portions which are folded relative to its connected panel and against which the other panel is secured in the assembled or erected position of the blank. Connected to the free edge or end of the latter panel is an end or closure flap arranged to be secured to the other panel in the erected position. The arrangement is such that the work to be protected or mailed can be laid flat upon a panel portion of the blank in its knockdown position of the blank, and the respective panel portions and associated flaps being readily folded about the art work or graphic, so as to form the erected carton about the art work in a simple and effective manner. The portions of the blank disposed in contiguous relationship when in the erected position of the blank are provided with a strip or layer of pressure sensitive adhesive, which is initially protected by a peelable protective strip until readied for use. In one form of the invention, a closure fastener is provided for rendering the end closure flap releaseable between an open or closed position. Also, a provision is provided for a detachable handle being connected to the erected carton or portfolio to facilitate carrying the erected carton or portfolio. The invention further contemplates a resilient spacer adapted to be secured to one of the panel portions to prohibit or restrict relative movement and/or resulting damage to the graphics or art work disposed within the carton or portfolio.

FEATURES

A feature of this invention resides in the provision of a relatively inexpensive mailing carton or portfolio for relatively large sized graphics, which is formed of a unitary blank of sheet material which can be readily folded about a work of art and secured in the erected position in a simple, efficient and positive manner.

Another feature resides in the provision whereby the mailing carton in the erected position can be utilized as a readily inexpensive portfolio for carrying graphics and/or art work in their flat state.

Another feature resides in the provision of a relatively inexpensive mailing carton and/or portfolio having a releaseable closure or end flap.

Another feature resides in the provision of a mailing carton or portfolio having a handle adapted to be detachably connected thereto.

Other features and advantages will become more readily apparent when considered in view of the drawing and specification in which:

FIG. 3 is a perspective view of the mailing carton or portfolio in the erected or assembled position thereof.

FIG. 4 is a sectional view taken along line 4—4 on FIG. 3.

FIG. 5 is a sectional view taken along line 5—5 on FIG. 3.

FIG. 6 illustrates a modified form of the invention.

FIG. 7 is a sectional view taken along line 7—7 on FIG. 6.

DETAIL DESCRIPTION

Figure 1:
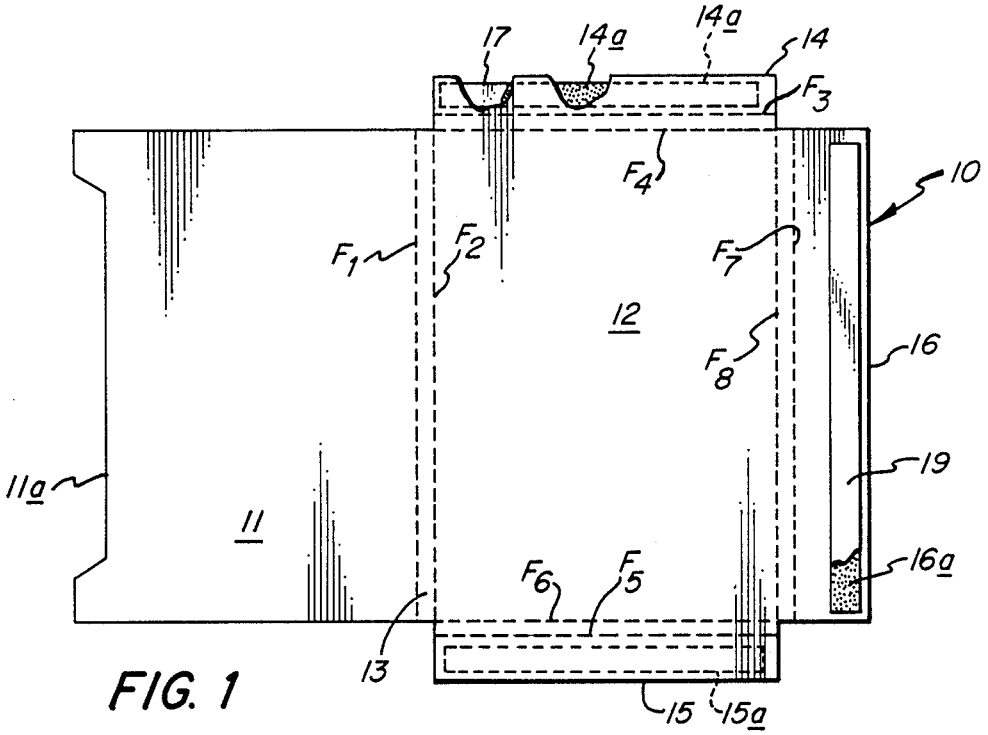
FIG. 1 is a plan view of the blank construction in the knockdown position.

Referring to FIG. 1, there is illustrated a preformed blank 10 shown in its knockdown or expanded position from which the mailing carton or portfolio is formed, as shown in FIG. 3. The blank 10, as will be herein described, is specifically preformed, scored or die-cut so as to be readily folded about a work of art, graphic, or mechanical W in a simple, effective and efficient manner. Such mechanicals or art work W are generally standard in size, which frequently may be as large as 20"×30"; 30"×40"; or larger. As a result, such sizes are frequently difficult to handle, carry, ship and/or protect.

As shown in FIG. 1, the blank 10 is sized to accommodate such relatively large size art work W. The blank 10 comprises a unitary sheet of cardboard or corrugated board that is pre-scored or die-cut to define a front panel 11 and a hingedly connected back panel 12. The respective front and back panels 11 and 12 are hingedly connected about a pair of transversely extending foldlines $F_1$ and $F_2$, which are spaced apart, the spacing 13 between $F_1$ and $F_2$, defining the distance between the front and back panels 11, 12, in the erected position of the blank 10. Generally, such spacing 13 may be approximately ⅜ of an inch. However, it is understood that such spacing between foldlines $F_1$ and $F_2$ may be varied, depending upon the desired thickness or depth of the carton desired. The respective sizes of the front and back panels 11 and 12 determines the maximum size of the art work W to be fitted to the carton or portfolio in the erected position.

Hingedly connected to one of the panels, e.g., the back panel 12, are opposed side or marginal flaps 14 and 15. The respective side or marginal flaps 14 and 15 are substantially co-extensive to the longitudinal edge of the adjacent back panel 12. As shown, the respective side or marginal flaps 14, 15, are hingedly connected relative to the adjacent back panel 12 about a pair of spaced apart foldlines $F_3$, $F_4$ and $F_5$, $F_6$ respectively. The arrangement is such that the spacing between foldlines $F_3$, $F_4$ and $F_5$, $F_6$ is substantially equal to spacing 13 between foldlines $F_1$ and $F_2$. Connected to the free end of the back panel 12 is an end or closure flap 16. A pair of transversely extending spaced apart foldlines $F_7$, $F_8$ are disposed between the end or closure flap 16 and the back panel 12 and about which the closure flap 16 is adapted to be folded in the erected position.

In accordance with this invention, the undersurface of the respective marginal or side flaps 14, 15 is provided with a layer or band of suitable pressure sensitive adhesive **14*a*, 15*a* respectively. The respective adhesive layers 14*a* and 15*a* are covered by a protective releaseable strip of material 17 and 18 respectively. In the illustrated form of FIG. 1, the closure or end flap 16 on the inner surface thereof is also provided with a layer of pressure sensitive adhesive layer 16*a*, which is initially covered or protected by a peelable or stripable covering material 19. With the blank 10 constructed as described, a plurality of such blanks can be readily shipped and/or stacked one on the other in their expanded or knockdown position without sticking to one another, as the respective adhesive bands or layers 14*a*, 15*a*, 16*a* are normally protected from making contact with an extraneous surface because of the protective covering strips 17, 18 and 19**.

Figure 2:
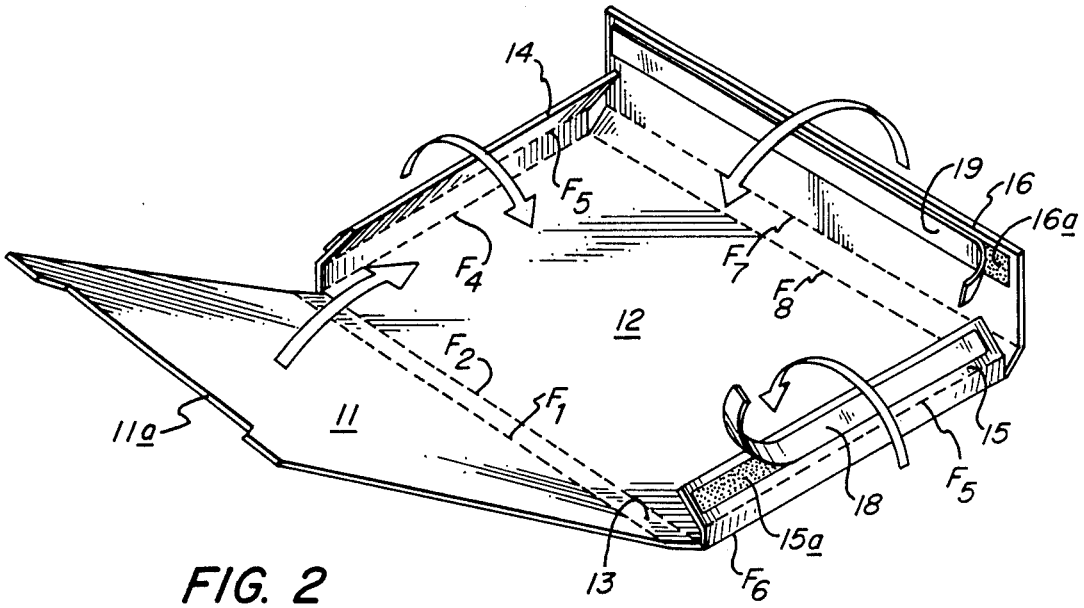
FIG. 2 illustrates the blank of FIG. 1 in a partially erected position.

To form the blank 10 to define the mailing carton or portfolio, as shown in FIG. 3, the user or artist need only place the graphic art or mechanical W onto the back panel 12 in the expanded position of the blank 10. With the graphic or art work W squarely placed on the back panel 12, the opposed side or marginal flaps 14 and 15 are respectively folded about their respective foldlines $F_3$, $F_4$ and $F_5$, $F_6$, whereby the marginal flaps 14 and 15 overlie the marginal portion of the back panel as seen in FIG. 2. In this position, the art work or graphic W is confined between the formed side or marginal flaps 14 and 15. The protective strip 17, 18 can now be peeled or removed to expose the underlying adhesive layer or band **14*a*, 15*a*. Accordingly, the front panel 12 is then folded about its respective foldlines $F_1$, $F_2$ into overlying position relative to the back panel 12. As the marginal portion of the front panel 12 engages the exposed adhesive layers 14*a*, 15*a* of the underlying marginal flaps, the front panel 12 becomes positively secured to the marginal flaps 14, 15, with the work of art or graphic W safely confined within the formed carton. To seal the carton so formed, the covering strip of material 19 is peeled off to expose the underlying adhesive layer 16*a*. By folding the end or closure flap 16 about its respective foldlines $F_7$, $F_8$ as shown in FIGS. 2 and 3, the closure flap 16 is adhesively secured to the underlying front panel, and thereby seals the art work or graphic W within the carton or mailer. The layer of pressure sensitive material 14*a*, 15*a* and 16*a*** comprises a suitable contact adhesive which, by the application of slight pressure, will effect a positive bond between it and the portion of the blank brought in direct contact therewith.

While the blank 10, as described, is provided with a layer or band of pressure sensitive adhesive on the undersurface of the side or marginal flaps 14 and 15 as shown in FIGS. 1 and 2, a variation thereof may be made whereby the layer of adhesive may be extended along the opposed longitudinal edges of the top panel 11 which are arranged to engage with the side flaps 14 and 15.

In lieu of layer or band **16*a* being formed on the end flap as shown in FIG. 1, the same result may be obtained by providing the layer or band of adhesive on the underside of the top panel which underlies the closure or end flap 16** in the assembled position.

Thus, it will be noted that wherever contacting portions of the blank 10 occur, the layer or band of adhesive need be located on only one of the contacting portions.

FIG. 6 illustrates an optional modification. As shown therein, a pair of slots or apertures 20 and 21 are formed in the spacing between foldlines $F_7$ and $F_7$ about which the end or closure flap 16 is folded. A handle member 22 in the form of a flexible plastic strip having a lateral protrusion 23 formed at the opposed ends thereof is provided, whereby the handle member 22 is rendered readily detachable to the erected carton. This is attained by inserting the ends of the handle member into the respective apertures 20 and 21 and disposing the lateral protrusions 22, 23, normal to the aperture 20 and 21. The width of the protrusion being larger than the width of the slot or aperture 20 and 21 causes the handle member 22 to be retained to the carton. Accordingly, the length of the apertures 20, 21 is sufficiently long to permit the insertion of the handle end portions when the lateral protrusions are twisted for insertion therein. The width of the slot or opening is less than the width of the lateral protrusions to prohibit unintentional removal of the handle 22.

If desired, a spacer 25 may be provided to firmly maintain a work of art or graphic W in place within the carton or portfolio. The spacer 25 comprises a piece of light weight rubber, fiber paper or plastic foam to maintain the art work immobile within the carton. The spacer 25 may be adhesively secured to one of the front or back panels, or may be loosely disposed within the carton or portfolio.

Figure 9:
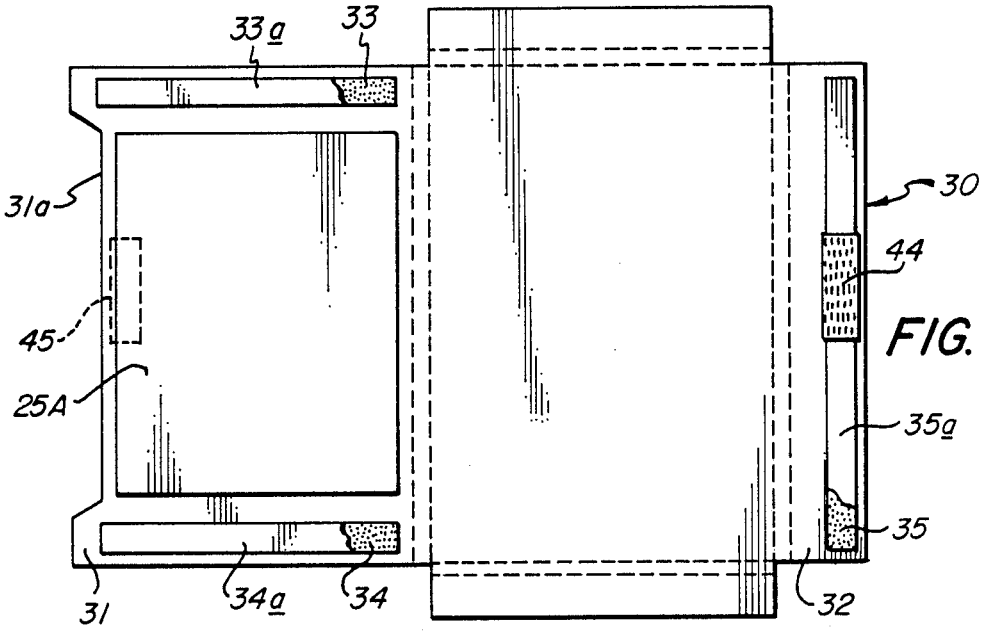
FIG. 9 is a plan view of a modified blank construction in the knockdown or expanded position.
Figure 8:
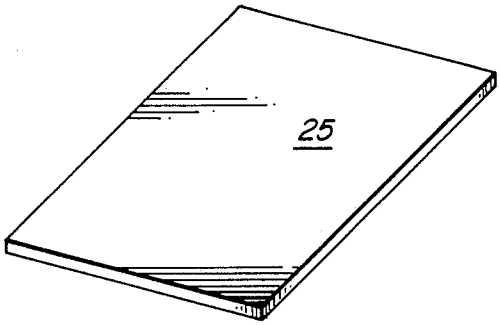
FIG. 8 is a perspective view of a detail of construction.
Figure 11:
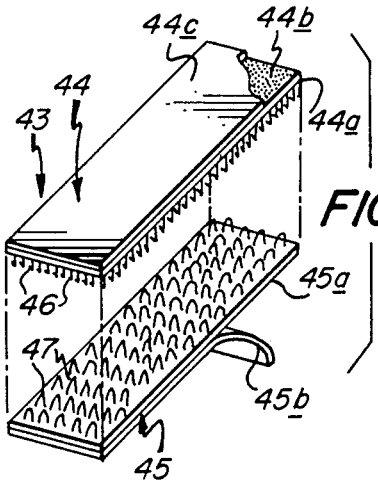
FIG. 11 is a detail exploded perspective view of the latching assembly as disclosed in FIGS. 9 and 10.
Figure 10:
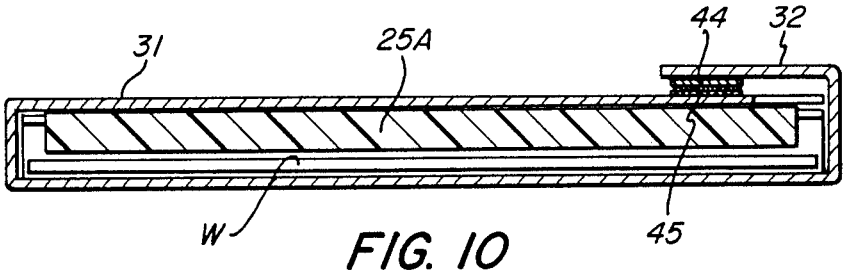
FIG. 10 is a cross sectional view of an erected portion of the blank illustrated in FIG. 9.

FIGS. 9 to 11 illustrate a modified form of the invention. In this form, the blank 30 is constructed as hereinbefore described. In this form, the front panel 31 has adhesively secured thereto a spacer element **25*a* to the inner surface thereof. The spacer element 25A comprises a soft, lightweight member, e.g., foam rubber or the like. Also, in this form of the invention, a releaseable latching or fastener assembly is provided for releaseably securing the end or closure flap 32 to the underlying front panel 31. As best seen in FIG. 11, the releaseably latching means 33 comprises a pair of complementary mating members 34 and 35. Such latching means may comprise complementary "VELCRO" type material. As shown, member 34 comprises a piece of complementary "VELCRO" 34*a*, which is adhesively backed as at 34*b*, and which adhesive back is protected by a stripable covering material 34*c***.

The other complementary portion 35 is also provided with an adhesive backed portion as at **35*a* which is also protected by a stripable covering material 35*b*. It will be noted that member 34 is provided with a contact surface of fine hook-like elements 36 which will releaseably lock onto the loop-like elements 37 of member 35. The releaseable latching means 33 as shown in Fg. 11 may be optionally supplied with a blank construction as herein described, whereby the user, if he or she so desires, may convert the mailing carton into a reuseable portfolio having a releaseable closure flap 32. This is attained simply by adhesively securing one element of the latching means 33, e.g. member 34, to an edge portion of the closure flap 32 and adhesively securing the other complementary element, e.g. member 35, to the underside of the front panel 31 as shown in FIG. 9. Thus, when the blank 30 of FIG. 9 is folded to its erected position, the latching member 35 is disposed opposite the member 34 connected to the closure flap 32 in the closed position of flap 32, as best seen in FIG. 10. In this manner, the closure flap 32 is releaseably secured in the closed position, thus enabling the erected form of the carton to be used as an inexpensive portfolio for carrying large size mechanicals or graphics in a flat, secured manner. The resilient spacer 25A** ensures firm maintenance of the art work within the carton or portfolio.

From the foregoing description, it will be apparent that the specifically constructed blank 10 or 30 provides a relatively simple and easily constructed mailing carton or portfolio for accommodating relatively large graphics or art works which can be readily folded about the art work in a simple and expedient manner. The described arrangement optionally provides a detachable handle means and an optional latching means for rendering the closure flap to be releaseably secured. As shown in FIGS. 1 and 9, the free end of the top panel 11 and 31 is provided with a central cut-out portion as indicated at **11*a* and 31*a*** to provide a means to facilitate the removal of the art work or graphic when the closure flap is opened.

In the embodiment of FIG. 1, the adhesive layer or band **14*a* or 15*a* are disposed on the undersurface of the side marginal flaps 14 and 15, as viewed therein; with the adhesive layer or band 16*a* disposed along the inner surface of the closure flap. In the embodiment of FIG. 9, the comparable adhesive layer or band 33 and 34 are disposed on the inner surface of the front panel 31. As noted in FIG. 1, the closure flap 32 is provided with an adhesive layer or band 35, which may be optionally used. As described, the respective adhesive layers 33, 34 and 35 of FIG. 1 are each provided with a protective releaseable covering strip 33*a*, 34*a* and 35*a* adapted to be readily peeled off the adhesive layer prior to folding the blank 30 to form the carton or portfolio as herein described. As shown in FIG. 9, the latching assembly 31 of FIG. 11 may be optionally used in lieu of the adhesive band 35**.

While the invention has been described with respect to several embodiments thereof, it will be appreciated and understood that variations and modifications may be made without departing from the spirit or scope of the invention.

What is claimed is:

1. A knockdown combination mailing carton and portfolio for flat graphic artwork, and which carton and portfolio is fabricated of a blank material adapted to be readily folded about a piece of artwork from its knockdown position to its erected position comprising a preformed blank of readily foldable rigid cardboard material having an inner surface and an outer surface.

said blank including a generally rectanglar front panel and a generally rectangular back panel, said front and back panel determining the maximum size of the artwork adapted to be received in the erected position of said carton and portfolio, a first pair of relatively closely spaced foldlines extending transversely of said blank to separate said front panel from said blank panel, whereby the spacing between said first pair of foldlines determines the thickness of the assembled carton and portfolio, a generally rectangular side marginal flap of width connected to each of the opposed longitudinal edges of said back panel, said side marginal flap being free of any fold line, each said side marginal flap having a width which is narrower than the width of each of said front and back panels, a second pair of relatively closely spaced foldlines extending longitudinally along each of the opposed longitudinal edges of said back panel to separate said back panel from the respective side marginal flaps, whereby the spacing of said second pair of foldlines corresponds to the thickness of said carton and portfolio in the erected position, a generally rectangular end flap connected to the free end of said back panel, said end flap having a width which is narrower than the width of each of the front and back panels, a third pair of relatively closely spaced foldlines extending transversely of said back panel adjacent the free end thereof for separating said end flap from said back panel, whereby the spacing between said third pair of foldlines correspond to the thickness of said carton and portfolio in the erected position, each of said side flaps being reversely foldable about its respective foldline whereby said side flaps in the erected position thereof are disposed in overlying parallel spaced relationship to said back panel, a narrow band of pressure sensitive adhesive disposed on each of said side flaps extending longitudinally thereof, said band of adhesive being adhered to the outer surface of its respective side flap, and each of said slide flaps having a uniform narrow width slightly greater than the said narrow band of pressure sensitive adhesives mounted thereon, a releaseable covering strip disposed over each of said bands of pressure sensitive adhesive mounted on said side flaps, said blank being readily formed to erected position and about the artwork by the folding of said side flaps into overlying and spaced relationship relative to said back panel and about the artwork, and removing said covering strip, and thereafter folding said front panel onto said side flaps whereby said front panel is adhesively secured by the exposed adhesive band on each of said side flaps, and said end flap being reversely folded onto said front panel to define a closure for said mailing carton and portfolio in the erected position thereof, and securing means for securing said end flap in the closed position, said securing means comprises an adhesive strip extending transversely along the length of said end flap, said adhesive strip having a width slightly less than the width of said end flap, said strip of adhesive being adhered on the inner surface of said end flap, and a releaseable covering strip for said adhesive strip, whereby said end flap in the erected position of said blank is adhesively secured to said front flap upon the removal of said covering strip.

* * * * *